US007329334B2

(12) United States Patent
Herdman et al.

(10) Patent No.: US 7,329,334 B2
(45) Date of Patent: Feb. 12, 2008

(54) CONTROLLING THE HARDNESS OF ELECTRODEPOSITED COPPER COATINGS BY VARIATION OF CURRENT PROFILE

(76) Inventors: Roderick D. Herdman, 3 Cedar Crescent Kingsbury, Tamworth, Staffordshire (GB) B78 2JQ; Trevor Pearson, 8 Cricketers Meadow Cradeley Heath, West Midlands (GB) B64 7HR; Ernest Long, 18 Watson Road, Chapelfields, Coventry (GB) CV5 8EW; Alan Gardner, 17 Middlesmoor, Wilnecote, Tamworth (GB) B77 4PL ( * ) Notice: Subject to any disclaimer, the term of this patent is extended or adjusted under 35 U.S.C. 154(b) by 233 days.

(21) Appl. No.: 10/943,113

(22) Filed: Sep. 16, 2004

(65) Prior Publication Data

US 2006/0054505 A1 Mar. 16, 2006

(51) Int. Cl.
*C25D 5/18* (2006.01)
*C25D 7/00* (2006.01)

(52) U.S. Cl. ..... 205/103; 205/151

(58) Field of Classification Search ..... 205/103, 205/151

See application file for complete search history.

(56) References Cited

U.S. PATENT DOCUMENTS 3,923,610 A * 12/1975 Bergin et al. ..... 205/103
4,666,567 A * 5/1987 Loch ..... 205/83
6,036,833 A * 3/2000 Tang et al. ..... 205/103
6,319,384 B1 11/2001 Taylor et al.
6,573,459 B2 * 6/2003 Baker et al. ..... 174/260
6,610,192 B1 * 8/2003 Step et al. ..... 205/297
6,723,219 B2 * 4/2004 Collins ..... 205/103
6,793,796 B2 * 9/2004 Reid et al. ..... 205/102
2002/0079228 A1 6/2002 Smith

OTHER PUBLICATIONS

F. A. Lowenheim, Electroplating, McGraw-Hill Book Co., New York, 1978, pp. 198-202.*

Effect of Pulsed Current on the Electrodeposition of Chromium and Copper, Trevor Pearson, Doctor of Philosophy, The University of Aston in Birmingham, Nov. 1989.

* cited by examiner

*Primary Examiner*—Susy Tsang-Foster
*Assistant Examiner*—William T. Leader
(74) *Attorney, Agent, or Firm*—Carmody & Torrance LLP

(57) ABSTRACT

Pulse reverse electrolysis of acid copper solutions is used for applying copper deposits of a controlled hardness for applications such as producing printing cylinders. The benefits include improved production capacity. Hardness of the deposit is controlled by varying at least one factor selected from the group consisting of (i) cathodic pulse time, (ii) anodic pulse time, (iii) cathodic pulse current density, and (iv) anodic pulse current density. Preferably the ratio of cathodic pulse time to anodic pulse time is varied.

15 Claims, 1 Drawing Sheet

The Variation of Deposit Hardness with Reverse Pulse Time at Different Forward Pulse Times
(The Current Density and Reverse:Forward Current Ratio are fixed)

Figure 1. The Variation of Deposit Hardness with Reverse Pulse Time at Different Forward Pulse Times
(The Current Density and Reverse:Forward Current Ratio are fixed)
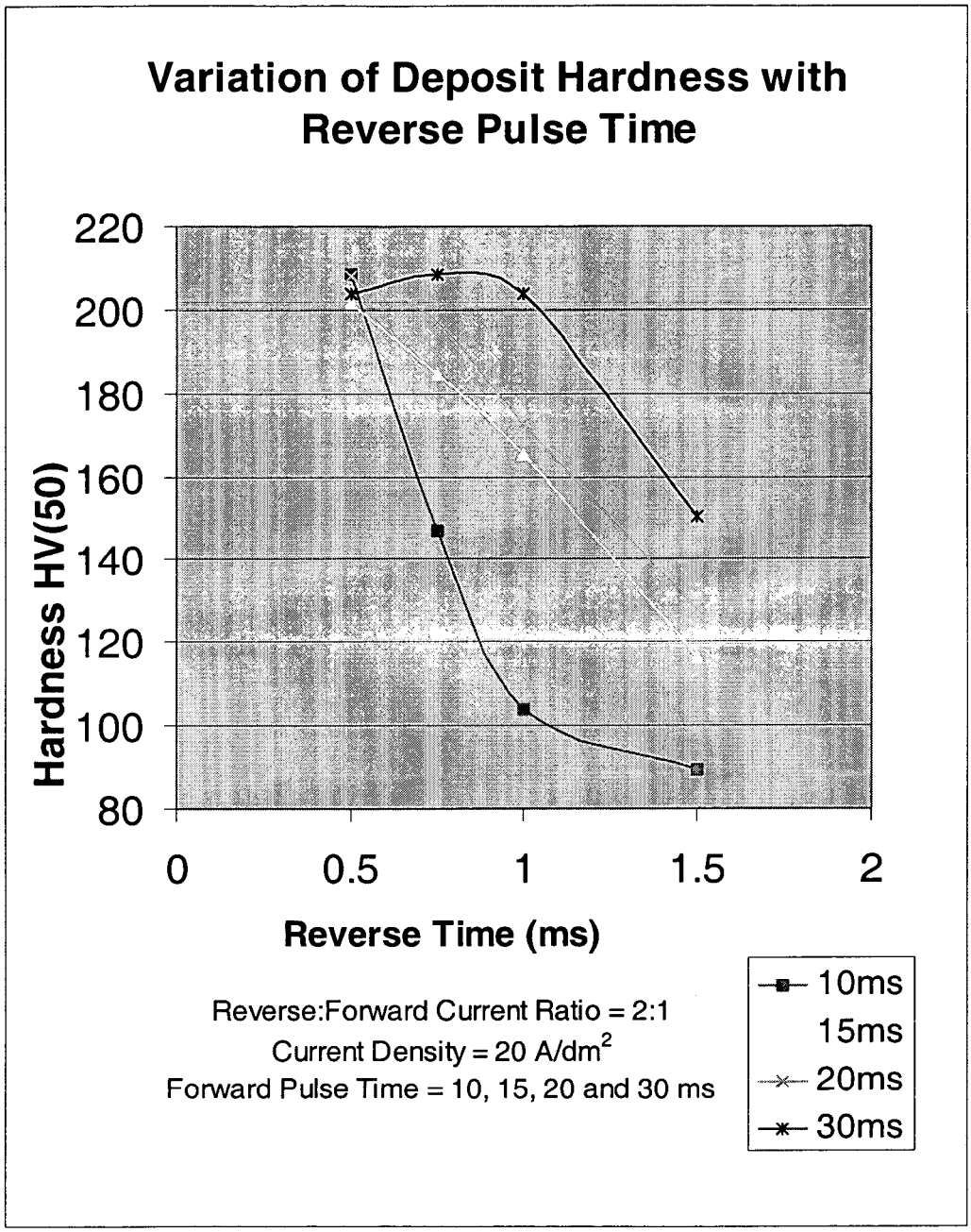

CONTROLLING THE HARDNESS OF ELECTRODEPOSITED COPPER COATINGS BY VARIATION OF CURRENT PROFILE

FIELD OF THE INVENTION

This invention relates to the plating of copper deposits from acidic solutions, and controlling the hardness of such deposits by variation of the profile of the applied current.

BACKGROUND OF THE INVENTION

The plating of copper from acid solutions is well known, with numerous industrial applications. In most applications the articles to be plated are suspended in the electrolyte, a technique hereafter called rack plating. Known applications include decorative finishes for household and automotive goods, electroforming, and production of printing cylinders. Other applications will be well known to those with knowledge of the electroplating industry.

The electroplating of parts normally takes place in a suitable tank containing an electrolyte into which the article to be plated is partially or wholly immersed. The article to be electroplated is suitably pre-treated prior to deposition of copper in order to provide a surface that will be receptive to the copper coating and give an adherent deposit. Copper deposition is effected by making the article to be plated the cathode in a circuit, and by passing a direct electric current through the article and electrolyte with suitable anodes completing the circuit with a power supply. The tanks are normally fitted with filtration and temperature control equipment to provide good process control. Solution agitation equipment such as air or solution movement may be utilised if desired.

The base composition of the electrolyte typically comprises 50-250 g/l of copper sulphate pentahydrate, 20-150 ml/l of concentrated sulphuric acid, optionally about 20-200 mg/l of chloride ion, and optionally proprietary additives. Baths typically used for electronics applications use low copper sulphate and high sulphuric acid concentrations, whilst baths typically used for electroforming, decorative applications or printing cylinder production generally use high copper sulphate and low sulphuric acid concentrations.

The use of pulse reverse plating techniques to deposit copper from acidic solutions is well-known within the electronics industry, for plating copper from acidic solutions onto printed circuit boards and other substrates. U.S. Pat. No. 6,319,384, to Taylor et al., the subject matter of which is herein incorporated by reference in its entirely, discloses a method for the electrodeposition of copper onto a semiconductor substrate, wherein the acidic copper plating bath is substantially devoid of brighteners and and/or levellers.

The basic chemistry of the additives used for electronics applications, and their performance under pulse reverse current plating conditions as compared to direct current conditions is explained by T. Pearson, "Effect of Pulsed Current On The Electrodeposition of Chromium and Copper", PhD thesis, Aston University, United Kingdom, 1989, the subject matter of which is herein incorporated by reference in it is entirety. The additives broadly comprise a sulphopropyl sulphide and a polyalkylene glycol that operate in conjunction with chloride ion. Generally these baths for electronics applications produce matt copper deposits that are relatively soft, in the order of 100 to 120 $HV_{50}$ (Vickers Hardness measured with a 50 g weight).

A recent U.S. application Ser. No. 10/274,634 describes the use of pulse reverse plating with acidic copper electrolytes for decorative copper applications such as plating on plastics for automobile or sanitary applications, or plating on alloy automobile wheels. The pulse plating process provides for improved distribution of the copper deposit across the substrate. Such baths also contain a levelling agent to provide for a bright and lustrous copper deposit.

A recent U.S. application No. 2002/0079228 (lapsed), attributed to Robert Smith, describes an apparatus and method for electroplating of gravure printing cylinders. The method employs the application of pulse reverse plating to a bath based upon copper sulphate, sulphuric acid and chloride ion with no additives to minimize surface pitting and nodules.

The production of printing cylinders requires a copper deposit of specific hardness and additives are generally used to control this. These additives are typically (but are not limited to) sulphur compounds added to the electrolyte, normally in the concentration range of 1-100 mg/l. Some printing cylinders require copper deposits to have a hardness of about 210 HV (e.g. rotogravure cylinders), whilst cylinders for other applications may require hardness of about 240 HV (embossing) or 190 HV (etching). Also it is necessary that the hardness remains stable over an extended period of time. Additive packages for use in decorative applications frequently produce deposits with hardness in the order of 200 $HV_{50}$ that self-anneal and become soft (120-150 $HV_{50}$) over a period of 1-2 weeks.

Electroplating chromium from hexavalent plating baths with pulsed current has been found to produce differences in hardness (Miller & Pan, Plating and Surface Finishing 1992 page 49). Sutter et al reported differences in hardness of nickel deposits by use of pulse current (Interfinish 1984), as did Kendrick (Trans. I.M.F. Vol 44 p 78-83) and Crossley et al (Trans. I.M.F. Vol 45 p 68-83). Pearson has also reported differences in the hardness of chromium deposited from hexavalent chromium solutions (T. Pearson, "Effect of Pulsed Current On The Electrodeposition of Chromium and Copper", PhD thesis, Aston University, United Kingdom, 1989), but found little difference in the hardness of copper deposits when plated by pulse reverse current instead of DC current. Hardnesses in the range of 100 to 120 $HV_{50}$ were reported when using electrolyte formulations typically used for electronic applications.

The current application discloses the invention that variation of current profile can be used to control the hardness of a copper deposit. This is of particular advantage to the plater of printing cylinders as the same electrolyte can be used to produce copper deposits of different hardness, thereby improving the operational adaptability of a plant. Additionally it may be possible to reduce the number of electroplating tanks required in the production plant, or alternatively to increase production capacity. However the inventors understand that the application of variable current profile to provide for hardness control of the copper deposit is not limited to the production of printing cylinders, and may also be used for other electroplating applications.

SUMMARY OF THE INVENTION

The use of pulse reverse plating to deposit copper can be used for a method of coating an article with copper from an acidic copper electroplating bath comprising the steps of:

(a) suspending the article in a plating bath comprising copper ions, counter ions, optionally chloride ions, a hardening additive or combination of additives, and optionally other known bath additives; and (b) plating the article for a period of time with pulse reverse current to produce a desired thickness of copper on the surface of said article, such copper deposit also having a controlled hardness.

BRIEF DESCRIPTION OF THE DRAWINGS

FIG. 1 illustrates the variation of deposit hardness with reverse pulse time.

DETAILED DESCRIPTION OF THE INVENTION

The present invention utilizes pulse-reverse current for plating articles with copper in an acidic copper plating bath to produce a desired thickness of copper on the surfaces of the articles, such copper deposit also having a desired and controlled hardness. The present invention is particularly useful for producing copper deposits with different hardnesses on different articles from the same electrolyte.

The acidic copper plating bath of the invention generally comprises copper ions, a source of counter ions, optionally chloride ions, and an additive for hardening the deposit. Other additives such as brightening and wetting agents known in prior art may also be added to the bath to improve the copper deposit.

Copper ions are present in the plating bath at a concentration of about 12 to 75 g/l. Copper sulphate pentahydrate is an example of a copper compound that is useful in the baths of the present invention. Other copper compounds known to those skilled in the art, such as copper methanesulphonate, and mixtures of such compounds, are also suitable. The plating bath generally comprises copper sulphate pentahydrate at a concentration of about 60 to 300 g/l, preferably about 70 to 250 g/l.

The source of counter ions in the plating bath is most commonly sulphate ions, but can be for example methanesulphonate ions or a mixture of such ions. A preferred source of sulphate ions is sulphuric acid. Where sulphate is the counter ion, sulphuric acid is normally present in the plating bath at a concentration of about 25 to 200 ml/l, preferably about 30 to 120 ml/l.

Optionally, depending on the bath additive chemistry, chloride ions may be present in the plating bath at a concentration of about 10 to 500 mg/l, preferably about 60 to 150 mg/l.

The hardening agent is present in the plating bath at a concentration sufficient to be effective in providing a hard copper deposit (generally 200-220 HV) as plated under DC conditions. Suitable hardening agents include sulphur (II) compounds such as thiourea or its derivatives. A levelling agent such as a phenazine dye can be used to produce a hard deposit when used in combination with a sulphoalkylsulphide, chloride ion and a polyalkylene glycol. The aforementioned hardening additives may be used singly or in combination. The concentration range in the electrolyte for these hardening additives is normally 1-100 mg/l. The inventors appreciate that other types of hardening agents may be used and the above examples are not limiting.

Other commercially available additives such as wetting agents, brighteners etc. may also be added to the plating bath compositions of the instant invention. The additives may be added to minimize pit formation, or to modify other deposit properties, for example the visual appearance.

The pulse plating regime of the plating bath generally consists of alternating cathodic and anodic pulses. The cathodic pulse time is generally between 2 and 100 ms, and the anodic pulse time is generally between 0.1 and 10 ms. Optionally, the plating regime may additionally include a cathodic period of extended time or may include a period of zero current ("dead time") between the pulses.

The average applied current density is generally between 1.0 and 35.0 A/dm$^2$ depending upon the application. For example the plating of printing cylinders generally uses a current density of 20 A/dm$^2$ and decorative copper applications generally use a current density of about 2 to 5 A/dm$^2$. The current density during the anodic pulse can be between 0 and 5 times the current density during the cathodic pulse, preferably 1 to 3 times the cathodic current density.

By controlling the pulse current profile applied to the bath during electrolysis, it has been found that the copper deposit can be made progressively softer than the full hardness obtained from DC deposition. To control the hardness of the copper deposit, variation should be made to at least one factor selected from the group consisting of (i) cathodic pulse time, (ii) anodic pulse time, (iii) cathodic pulse current density and (iv) anodic pulse current density. The variation should preferably be to the ratio of corresponding factors (ie. cathodic pulse time/anodic pulse time and/or cathodic pulse current density/anodic pulse current density). Preferably hardness is controlled through variations in cathodic pulse time and/or anodic pulse time. The hardness can be controlled in a predictable manner, thus allowing the operator to obtain cylinders of differing hardness from a single copper plating bath.

EXAMPLES

The following non-limiting examples demonstrate various attributes of the instant invention. In the following examples, an acidic copper electrolyte containing 150 g/l copper sulphate pentahydrate, 100 ml/l of sulphuric acid, 90 mg/l of chloride ion and proprietary additives (CuMac Pulse, available from MacDermid Inc.) was used. Brass test panels 50 mm wide by 90 mm deep were immersed to a depth of 50 mm in a Hull cell and electroplated with a copper deposit of sufficient thickness to measure the hardness. The electrolyte was operated at 30° C. and a phosphorised copper anode was used. A magnetic stirrer was used to agitate the solution. The hardness was measured using a calibrated Vickers microhardness tester manufactured by Leitz, with a test load of 50 g. The hardnesses were monitored over a period of 4 weeks and were found to be stable.

| Example No. | Forward Pulse time (ms) | Reverse Pulse time (ms) | Current Ratio (Reverse/Forward) | Average Current Density (A/dm$^2$) | Hardness ($HV_{50}$) |
|---|---|---|---|---|---|
| 1 (prior art) | DC | DC | DC | 5 | 203.6 |
| 2 (prior art) | DC | DC | DC | 20 | 207.6 |
| 3 | 10 | 0.5 | 2 | 5 | 206.6 |
| 4 | 10 | 0.5 | 2 | 20 | 208.3 |
| 5 | 10 | 0.5 | 2 | 30 | 205.6 |
| 6 | 10 | 0.75 | 2 | 20 | 146.8 |
| 7 | 10 | 1.0 | 2 | 20 | 104.1 |
| 8 | 10 | 1.5 | 2 | 20 | 89.4 |
| 9 | 10 | 1.0 | 1 | 20 | 181.7 |
| 10 | 10 | 1.5 | 1 | 20 | 145.9 |
| 11 | 15 | 0.5 | 2 | 20 | 201.5 |
| 12 | 15 | 0.75 | 2 | 20 | 184.5 |
| 13 | 15 | 1.0 | 2 | 20 | 165.5 |
| 14 | 15 | 1.5 | 2 | 20 | 116.2 |

-continued

| Example No. | Forward Pulse time (ms) | Reverse Pulse time (ms) | Current Ratio (Reverse/ Forward) | Average Current Density ($A/dm^2$) | Hardness ($HV_{50}$) |
|---|---|---|---|---|---|
| 15 | 20 | 0.5 | 2 | 20 | 208.1 |
| 16 | 20 | 0.75 | 2 | 20 | 197.1 |
| 17 | 20 | 1.0 | 2 | 20 | 172.7 |
| 18 | 20 | 1.5 | 2 | 20 | 127.6 |
| 19 | 30 | 0.5 | 2 | 20 | 203.8 |
| 20 | 30 | 0.75 | 2 | 20 | 208.4 |
| 21 | 30 | 1.0 | 2 | 20 | 203.8 |
| 22 | 30 | 1.5 | 2 | 20 | 150.5 |

Examples 1 and 2 were plated using DC current and demonstrate the prior art. Examples 3-22 demonstrate how the hardness of the deposit can be reduced from the maximum by manipulation of the pulse current profile.

The results from some of the above examples can be summarised graphically as demonstrated in FIG. 1 (page 10), clearly showing a predictable relationship between the pulse pattern and the deposit hardness.

The above examples clearly demonstrate the usefulness of the invention in controlling the hardness of the deposit produced from the electrolyte by variation of the current profile.

What is claimed is:

1. A method of electroplating an article in an acidic copper electroplating bath comprising the steps of:

(a) suspending said article in the acidic copper electroplating bath;

(b) plating said article for a period of time with a pulse-reverse current profile to produce a desired thickness of copper on the surface of said article;

wherein the hardness of the plated copper is controlled to a level between about 89 and 208 $HV_{50}$ by controlling the ratio of cathodic pulse time to anodic pulse time or cathodic pulse current density to anodic pulse current density, wherein the acidic copper electroplating bath comprises a hardening agent comprising a sulfur (II) compound, and a Polyalkylene glycol and wherein the plated copper is softer than copper plated from the same electroplating bath under direct current plating.

2. The method according to claim 1, wherein the electroplating bath comprises copper ions at a concentration of about 12-75 g/l and sulfate counter ions.

3. The method according to claim 2, wherein the electroplating bath comprises sulphuric acid (98% by wt.) at a concentration of about 25-200 ml/l.

4. The method according to claim 2, wherein the electroplating bath comprises chloride ions at a concentration of about 10-500 mg/l.

5. The method according to claim 1, wherein the plating bath further comprises a material selected from the group consisting of wetting agents, brighteners, and levelers.

6. The method according to claim 1, wherein the pulse plating current profile consists of alternating cathodic and anodic pulses.

7. The method according to claim 6, wherein the cathodic pulse time is 2 -100 ms.

8. The method according to claim 6, wherein the anodic pulse time is 0.1 -10 mns.

9. The method according to claim 6, wherein the pulse profile further comprises a cathodic period of extended time.

10. The method according to claim 9, wherein the extended cathodic pulse is up to 1 hour.

11. The method according to claim 6, wherein the pulse profile comprises a period of zero current between the cathodic and anodic pulses.

12. The method according to claim 1, wherein the average applied current density is 1.0-35.0 $A/dm^2$.

13. The method according to claim 12, wherein the current density during the anodic pulse is between 0 and 5 times the current density during the cathodic pulse.

14. The method according to claim 1, wherein the forward pulse time is about 10 mns, the reverse pulse time is between about 1.0 and 1.5 ms, and the reverse/forward current ratio is about 2:1 to control the hardness to between about 89 and 104 $HV_{50}$.

15. The method according to claim 1, wherein the article to be plated is a gravure printing cylinder.

* * * * *